US005637040A

United States Patent [19]

Kim et al.

[11] Patent Number: 5,637,040

[45] Date of Patent: Jun. 10, 1997

[54] INFRARED OBJECT DETECTOR

[75] Inventors: Tae-ho Kim, Ansan; Sung-soo Lee, Suwon; Won-kyo Jung, Anyang, all of Rep. of Korea

[73] Assignee: Samsung Electronics Co., Ltd., Suwon, Rep. of Korea

[21] Appl. No.: 630,647

[22] Filed: Apr. 10, 1996

[30] Foreign Application Priority Data

Apr. 13, 1995 [KR] Rep. of Korea ..... 95-8720

[51] Int. Cl.[6] ..... G08B 13/18

[52] U.S. Cl. ..... 454/256; 165/237; 250/221; 250/353; 340/567

[58] Field of Search ..... 454/256, 313, 454/314, 315, 338; 340/567, 555; 250/221, 353, 342, 349; 165/16

[56] References Cited

U.S. PATENT DOCUMENTS

| | | | |
|---|---|---|---|
| 4,484,075 | 11/1984 | Kahl, Jr. et al. | 250/353 X |
| 4,523,095 | 6/1985 | Keller-Steinbach | 250/353 X |
| 4,671,458 | 6/1987 | Fukuda et al. | 165/16 X |
| 4,772,797 | 9/1988 | Kahl et al. | 250/353 |
| 4,849,737 | 7/1989 | Kirihata et al. | 340/567 |
| 5,221,919 | 6/1993 | Hermans | 340/567 |

*Primary Examiner*—Harold Joyce

*Attorney, Agent, or Firm*—Burns, Doane, Swecker & Mathis, LLP

[57] ABSTRACT

An infrared object detector, especially for an air conditioner is provided with a light receiving unit including a light block between a pair of hemispherical Fresnel lenses arranged in parallel on a printed circuit board, so that light receiving views intersect each other to thereby define three detection areas. From a signal output from the light receiving unit, the distance to a detected object is determined through a signal processing circuit and a program built in a microcomputer. The rotational speed of a fan in the air conditioner is classified into three stages according to the determined distance, and a command is issued for controlling the operation of an air conditioner according to the number, movements, movement degrees to persons. Therefore, the airflow of the air conditioner is controlled based on the command, thereby performing an optimum air conditioning. Further, the infrared object detector can be applied to a camcorder or a camera, to determine the distance to an object more accurately.

12 Claims, 8 Drawing Sheets

AMPLIFIER OUTPUT WAVEFORM

A/D CONVERSION FUNCTION

REFERENCE VALUE RANGES

VOLTAGE LEVELS FOR DISTANCES

ΔV1 : VOLTAGE VALUE FOR SHORT DISTANCE

ΔV2 : VOLTAGE VALUE FOR MEDIUM DISTANCE

ΔV3 : VOLTAGE VALUE FOR LONG DISTANCE

INFRARED OBJECT DETECTOR

BACKGROUND OF THE INVENTION

The present invention relates to an object detector employing an infrared superconductive device, in which the location of an object is detected.

An infrared detector finds its general use in a control device for an automatic door or in a burglar alarm device. Such an infrared detector senses an object present in a specific detection area. A method for defining the detection area will be described.

As shown in FIG. 1, an infrared detector 1 is installed on the upper part of an entrance wall or on a ceiling 2, and a detection area is defined with respect to a floor 3, opposing the infrared detector 1. In this method, an object like a person 4 is detected so long as it steps into the shaded area of FIG. 1.

Further, an object detection range may be limited to a predetermined distance from the infrared detector by adjusting the sensitivity thereof. That is, the detection range reaches far by increasing the sensitivity, and is confined to a short distance by decreasing the sensitivity.

However, a problem with the prior art is that the infrared detector cannot be widely used, due to area constraints involved in its installation. Another problem is that installing the infrared detector in a high place (e.g., on a ceiling) is a difficult task, which makes it less acceptable in terms of safety and maintenance. Further, the detection range itself is not easy to control by adjusting the sensitivity of the infrared detector, resulting in frequent adjustments depending on ambient conditions like weather and needs for cooling or heating.

To overcome the above problems of the prior art, an infrared object detector shown in FIGS. 2 and 3 has been suggested. This infrared object detector is easy to install and obviates the need for additional control of the sensitivity thereof. As shown, it is comprised of a pair of light receiving elements arranged in such a way that their light receiving views intersect each other in a detection area, a pair of comparators for comparing the output levels of the pair of light receiving elements with their respective reference levels and outputting respective detection signals for an object, and a determiner for determining whether the object exists in the predetermined detection area, according to the concurrence of the detection signals.

In the conventional infrared object detector as constituted above, the detection area is defined where the light receiving views of the pair of light receiving elements intersect each other. When an object enters the detection area, both the light receiving elements concurrently produce their detection signals. Therefore, the absence or presence of the object in the detection area is determined on the basis of the concurrent detection signals.

Referring to FIGS. 2 and 3, the infrared object detector is comprised of a sensing unit 10 and a signal processing unit 20. The sensing unit 10 has light receiving windows 11*a* and 11*b* at both end portions of the front surface thereof. A detection area D is defined by the intersection of the light receiving views of the light receiving windows 11*a* and 11*b*, as shown in FIG. 2. The light receiving views of the light receiving windows 11*a* and 11*b* are defined by hoods 12*a* and 12*b*. An optical system (not shown) and infrared sensors 13*a* and 13*b* are arranged behind the hoods 12*a* and 12*b*. The outputs of the infrared sensors 13*a* and 13*b* are amplified in amplifiers 21*a* and 21*b* and transmitted to window comparators 22*a* and 22*b*, respectively. An AND circuit 23 receives the amplified outputs through the window comparators 22*a* and 22*b*, thereby producing a determination output.

The constitution of the infrared sensors 13*a* and 13*b* is illustrated in FIG. 4A. Each of the infrared sensors 13*a* and 13*b* includes a superconductive device 15 in a package 14. The output of the superconductive device 15 is impedance-transformed in a field effect transistor (FET) 16, and the impedance-transformed signal is output to the signal processing unit 20. A transparent window member 17 is provided to a light receiving aperture of the package 14, and an optical lens 18 is disposed in front of the transparent window member 17.

FIG. 4B illustrates the signal output $V_{out}$ of the infrared sensor 13. When an object appears in a light receiving view at the time point of t1 and disappears from the view at the time point of t2, the intensity of infrared incident light is changed, so that both outputs $V_{out}$ of the infrared sensors 13*a* and 13*b* are inverted with respect to the time points 1 and 2, respectively, as shown in FIG. 4B.

Referring to FIG. 5, 5A and 5B indicate the impedance-transformed outputs of the infrared sensors 13*a* and 13*b*, respectively. WA and WB indicate the outputs of the window comparators 22*a* and 22*b*, respectively. $V_{TU}$ and $V_{TL}$ indicate a high level reference potential and a low level reference potential of the window comparators 22*a* and 22*b*, respectively. As shown in FIGS. 5A and 5C, when an object is located at a short or long distance (see FIG. 3), the outputs of the window sensors 22*a* and 22*b* are not concurrently produced, while when the object exists in the detection area (medium distance), the concurrence of the outputs is obtained, as indicated by shaded portions of FIG. 5B.

Therefore, the absence or presence of the object in the detection area can be determined by the output OUT of the AND circuit 23.

Efforts have been recently expended toward applications of such an infrared object detector to such an air conditioner as a room air conditioner (RAC) or a package air conditioner (PAC), so that the location of a person present indoor is detected, thereby operating the air conditioner in an optimum state.

However, the conventional infrared object detector exhibits limitations in its application to an air conditioner, in that the two-dimensionally defined detection area is an obstacle to the three-dimensional detection of a person in consideration of the distance between the detector and the person and the degree of his movement. As a result, the air conditioner cannot be controlled properly enough to produce the optimum output.

SUMMARY OF THE INVENTION

To overcome the limitations of the conventional infrared object detector and improve it, it is an object of the present invention to provide an infrared object detector for detecting the location of an object sensed in a detection area.

It is another object of the present invention to provide an infrared object detector for an air conditioner, which detects the location of a person, to thereby operate the air conditioner in an optimum output state.

To achieve the above object, there is provided an infrared object detector comprising: light receiving means having at least one pair of light receiving lenses on a surface of a printed circuit board, light receiving views of the light receiving lenses intersecting each other to define a plurality of detection areas; signal processing means having a light receiving element arranged on the printed circuit board, corresponding to each of the light receiving lenses, an amplifier electrically coupled to the light receiving element, a window comparator for comparing an output signal of the amplifier with a reference signal thereof, and a signal converter coupled to the amplifier in parallel with the window comparator for converting the output signal from the amplifier; and determining means for determining the distance of a detection area where an object is located, through a signal output from the signal processing means.

In the infrared object detector, it is desirable that the light receiving lenses are a pair of Fresnel lenses arranged in parallel, and light blocking means is provided between the Fresnel lenses so that the light receiving views of the Fresnel lenses intersect each other, thereby defining substantially three detection areas. Preferably, the pair of Fresnel lenses has a hemispherical light incident surface, and the light blocking means is a light blocking tape or a mask formed between the Fresnel lenses. The signal converter is preferably an A/D converter.

To achieve another object, there is provided an infrared object detector for an air conditioner, comprising: light receiving means having light blocking means between a pair of Fresnel lenses arranged on a surface of a printed circuit board, so that the light receiving views intersect each other to thereby define three detection areas; signal processing means having a pair of light receiving elements disposed corresponding to the Fresnel lenses, an amplifier for amplifying an output signal of each of the light receiving elements, a window comparator for comparing an output signal of the amplifier with a reference signal, and an A/D converter coupled to the amplifier in parallel with the window comparator, for converting the output signal of the amplifier; and a microcomputer for receiving a signal output from the signal processing means, determining a distance area where an object is located, and outputting a command signal for controlling the operation of an air conditioner according to the distance.

In the infrared object detector for an air conditioner, preferably, the signal processing means comprises an AND/NOT gate, for classifying signals output from two signal processing circuits thereof into the signal waves for signal detection areas, and determining a corresponding signal detection area, and the microcomputer outputs a command signal for controlling the rotational speed of a fan in the air conditioner in three stages according to the signal wave for the detection area output from the signal processing means, thereby controlling the airflow of the air conditioner according to the number and movement degree of persons who are present in the detection area.

BRIEF DESCRIPTION OF THE DRAWINGS

The above objects and advantages of the present invention will become more apparent by describing in detail preferred embodiments thereof with reference to the attached drawings in which.

DETAILED DESCRIPTION OF THE INVENTION

A preferred embodiment of an infrared object detector of the present invention and its application to an air conditioner will be described in detail, referring to the attached drawings.

Figure 1:
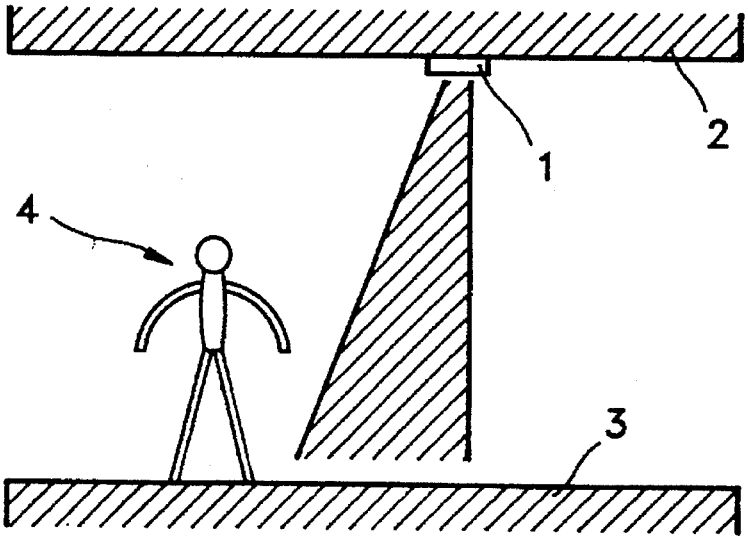
FIG. 1 (PRIOR ART)
FIG. 1 is a view for explaining a conventional infrared object detector.
Figure 2:
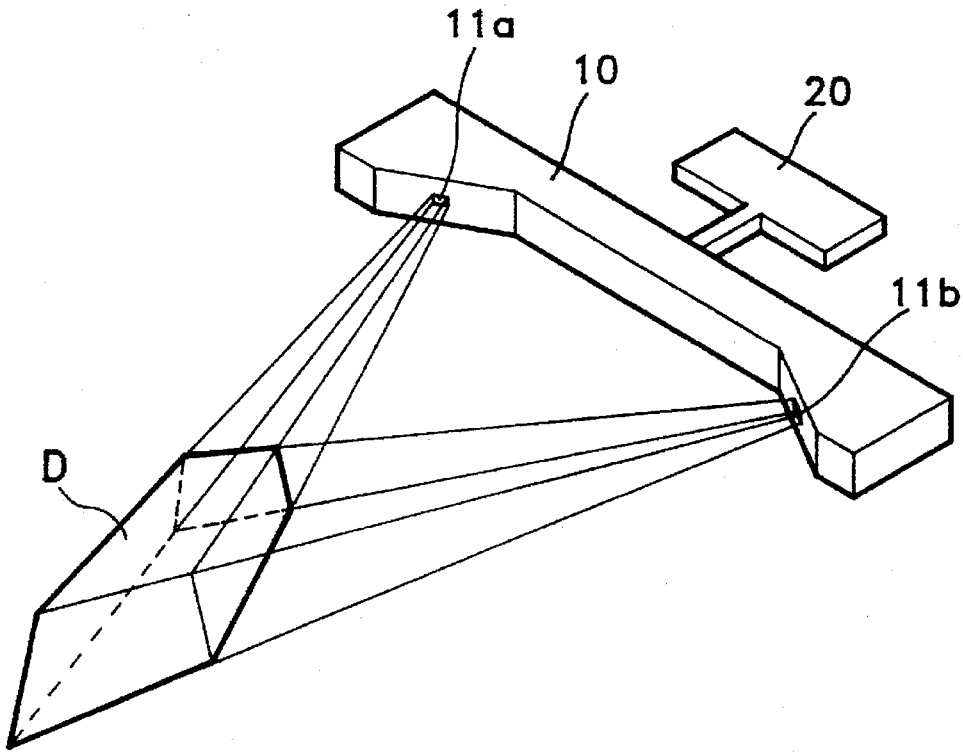
FIG. 2 (PRIOR ART)
FIG. 2 is a perspective view of another conventional infrared object detector.
Figure 3:
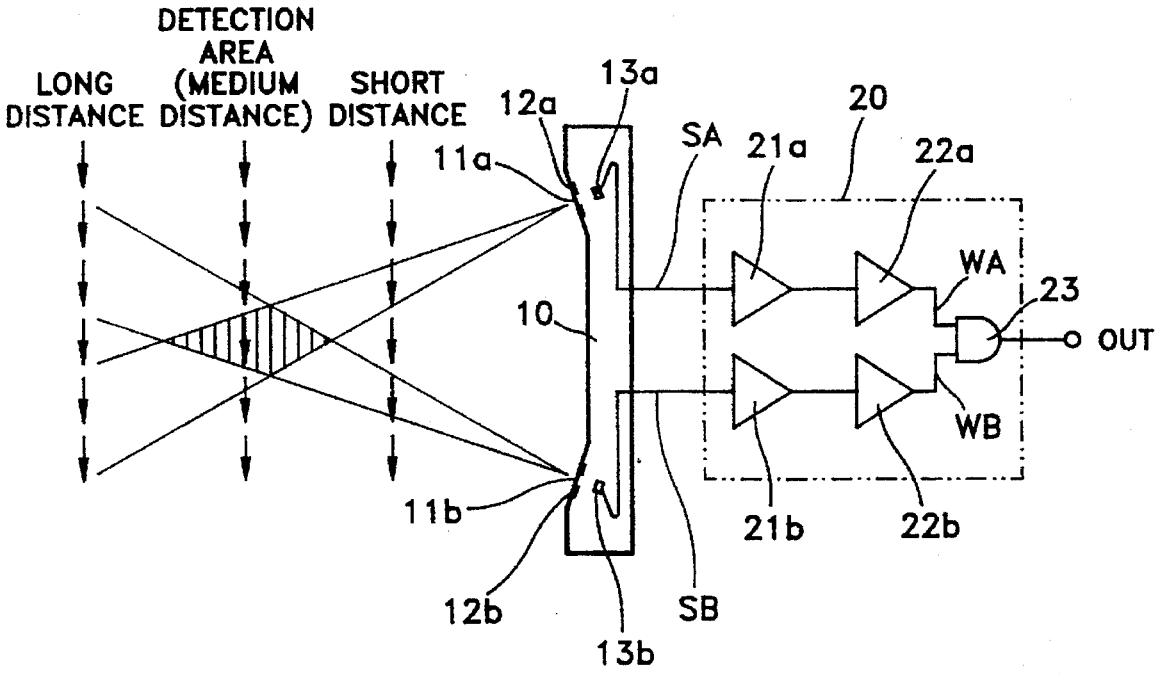
FIG. 3 (PRIOR ART)
FIG. 3 is a schematic plan view of the infrared object detector of FIG. 2.
Figure 4A:
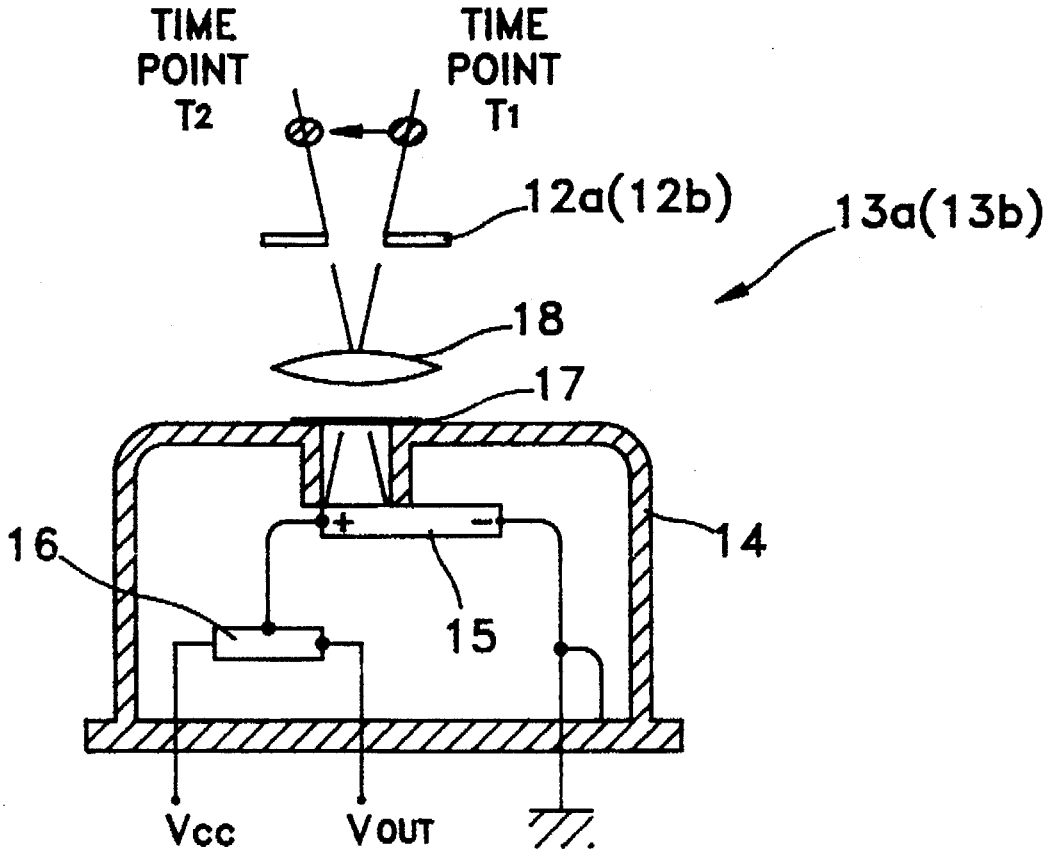
FIG. 4A (PRIOR ART)
FIGS. 4A and 4B are views for explaining the constitution and operation of the infrared sensors of FIG. 3.
Figure 4B:
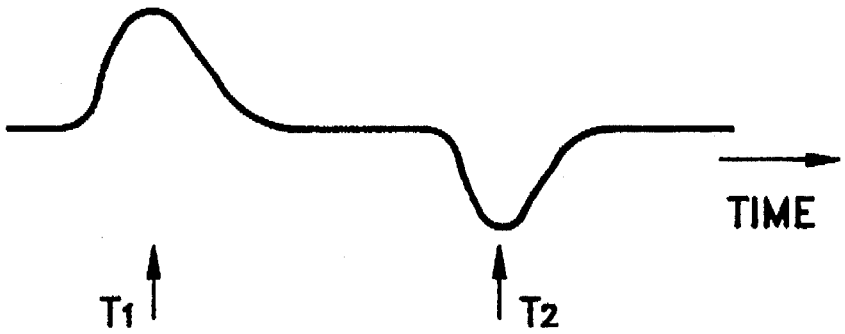
FIG. 4B (PRIOR ART)
Figure 5A:
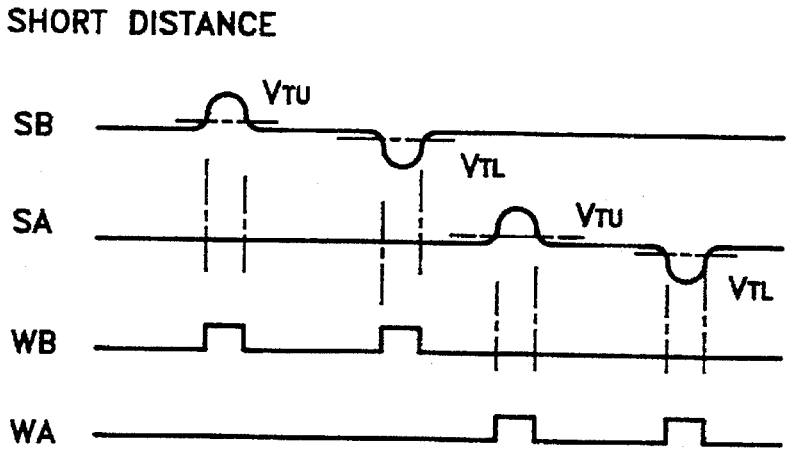
FIG. 5A (PRIOR ART)
FIGS. 5A–5C illustrate the waveforms of signals for explaining the operation of the infrared object detector of FIGS. 2 and 3.
Figure 5B:
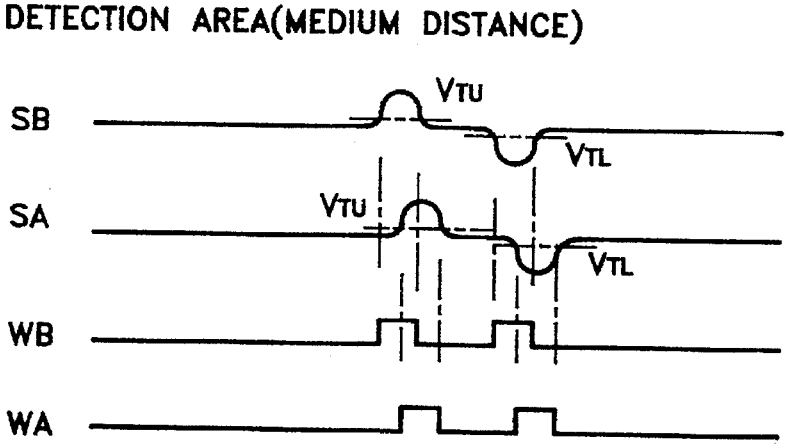
FIG. 5B (PRIOR ART)
Figure 5C:
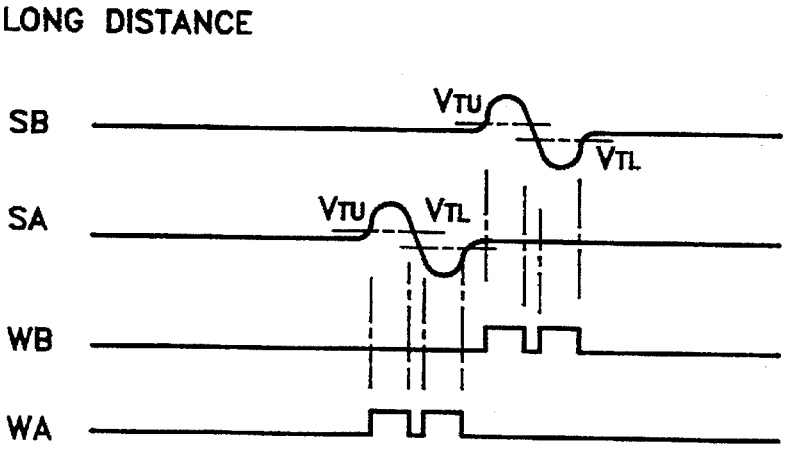
FIG. 5C (PRIOR ART)
Figure 6:
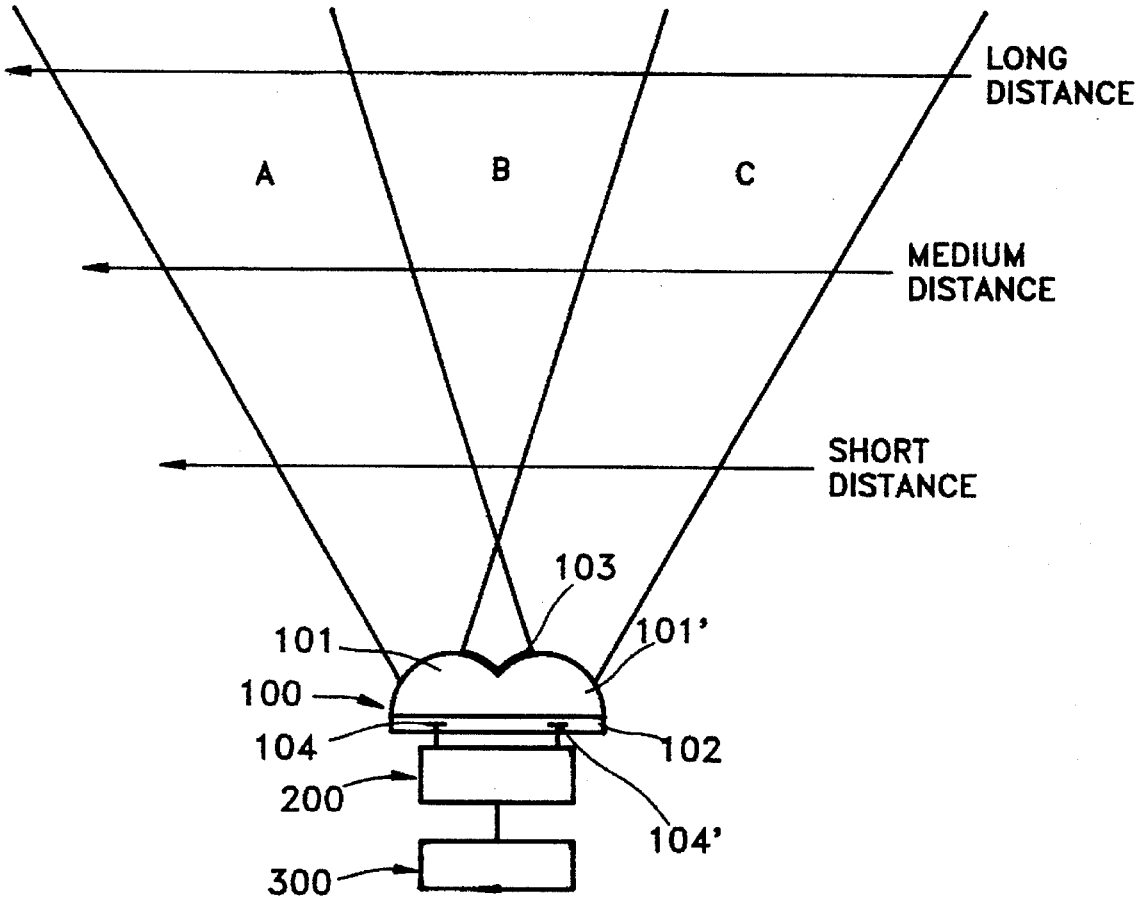
FIG. 6 schematically illustrates an infrared object detector for an air conditioner and its detection areas, according to the present invention.
Figure 7:
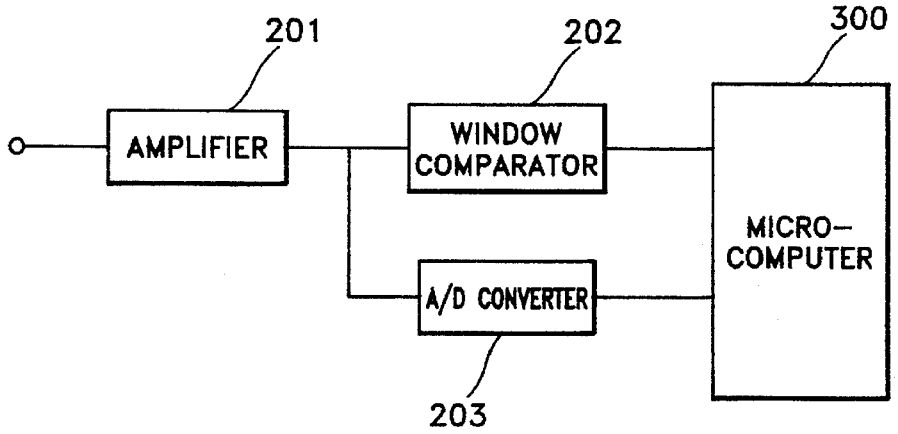
FIG. 7 is a schematic block diagram of the infrared object detector for an air conditioner of FIG. 6.

Referring to FIGS. 6 and 7, the infrared object detector of the present invention is comprised of a light receiving unit 100, a signal processing unit 200, and a microcomputer 300.

The light receiving unit 100 includes two Fresnel lenses 101 and 101' each having a hemispherical light-incident surface and arranged in parallel with a predetermined distance between them on a surface of a printed circuit board 102, to achieve a predetermined light incident angle. A partial mask or a light blocking tape 103 as light blocking means is attached between the Fresnel lenses 101 and 101', so that light receiving views intersect each other in a predetermined detection area. Therefore, as shown in FIG. 6, a first detection area A, a second detection area B and a third detection area C are substantially obtained, and each detection area is further divided into "a short distance area," "a medium distance area" and "a long distance area" according to the linear distance between the detector and an object. Chips including superconductive devices 104 and 104' are built in the Fresnel lenses 101 and 101', respectively.

The signal processing unit 200 has an amplifier 201 coupled to each of the superconductive devices 104 and 104', a window comparator 202 coupled to the amplifier 201, and an analogue-digital (A/D) converter 203 coupled to the amplifier 201 in parallel with the window comparator 202.

The microcomputer 300 has a microprocessor built therein, and is coupled to the window comparator 202 and the A/D converter 203.

The operation of the infrared object detector for an air conditioner according to the present invention, as constituted above, will be described.

Figure 8A:
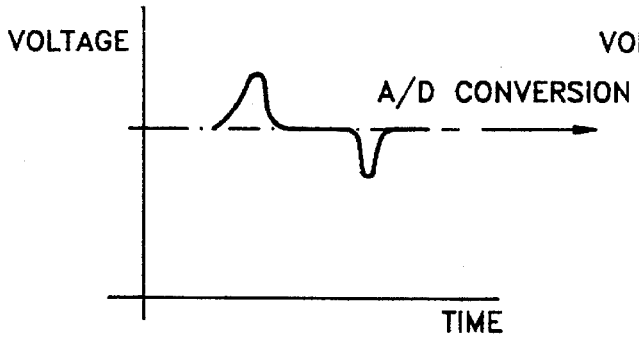
FIG. 8A illustrates an output waveform of the amplifier in the infrared object detector for an air conditioner according to the present invention.
Figure 8B:
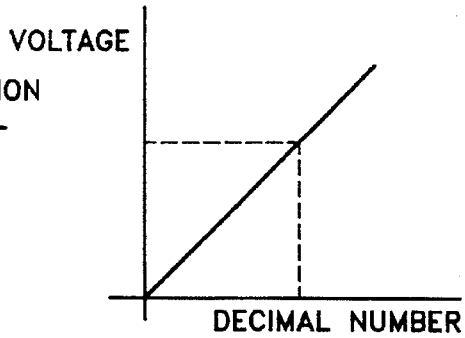
FIG. 8B is the graph of an A–D conversion function in the infrared object detector for an air conditioner according to the present invention.
Figure 8C:
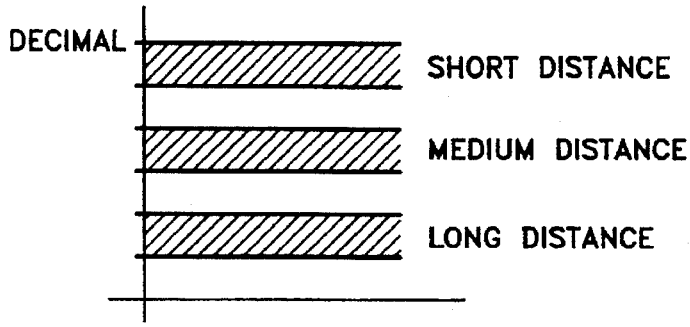
FIG. 8C illustrates reference value ranges for the detection areas in the infrared object detector for an air conditioner according to the present invention.
Figure 8D:
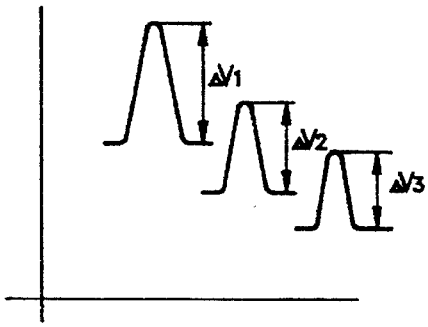
FIG. 8D illustrates voltage levels for the detection areas in the infrared object detector for an air conditioner according to the present invention.
Figure 9:
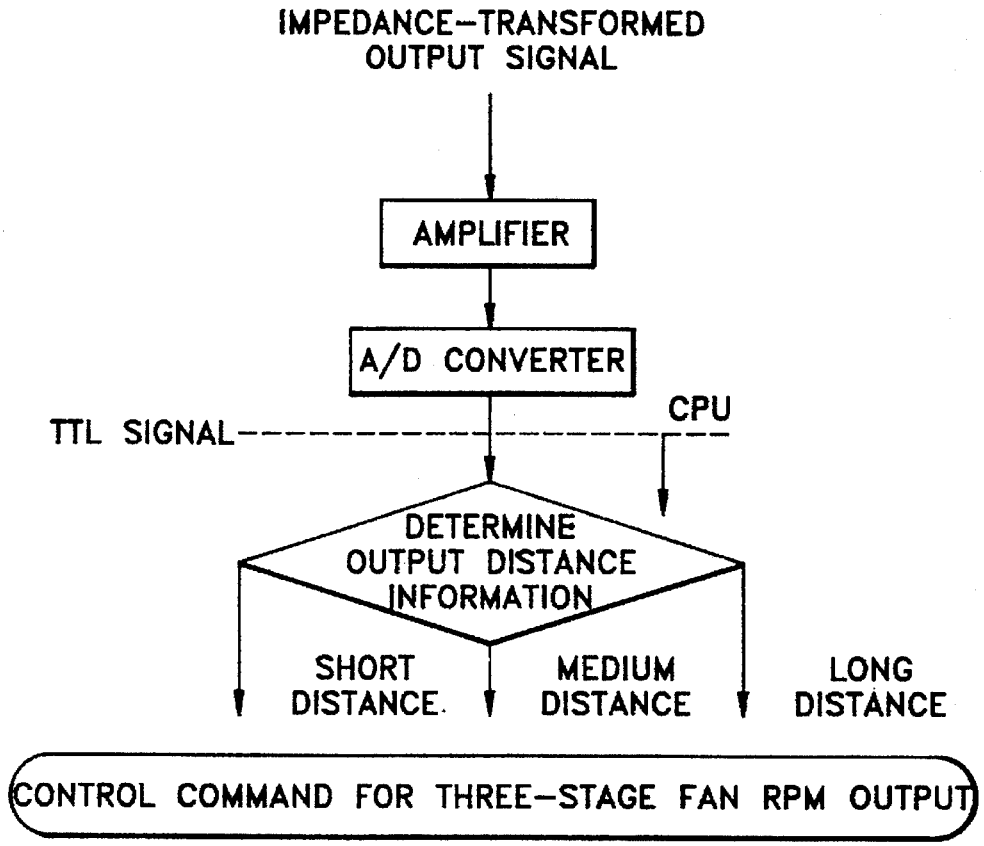
FIG. 9 is a flow-chart for explaining a method for determining the position of an object detected by the infrared object detector for an air conditioner according to the present invention.

For instance, when a person is present in the first detection area A of FIG. 6, the superconductive device 104 senses a temperature variation in the area and outputs an electrical signal representative of the temperature variation to the amplifier 201. All components of the signal excluding a component of a predetermined frequency band thereof are removed by the amplifier 201, and the filtered fine signal is converted into an analogue signal which is amplified by the amplification gain of FIG. 8A. The analogue signal is output to the window comparator 202 and the A/D converter 203. At this time, a signal having a voltage level indicative of one of the three classified distance areas, according to the distance to the person is generated, as shown in FIG. 8D. This signal is converted into a digital signal in the A/D converter 203 and output in binary codes to the microcomputer 300. The microcomputer 300 designates three decimal value corresponding to respective voltage levels by its built-in program shown in FIG. 9, and determines the distance to the detection area.

The analogue signal received in the window comparator 202 is converted into a digital signal of a square wave. The window comparator 202 outputs two square pulses corresponding to a high level reference voltage and a low level reference voltage, because a signal of a sine wave is generated when a person passes through a detection area.

Figure 10:
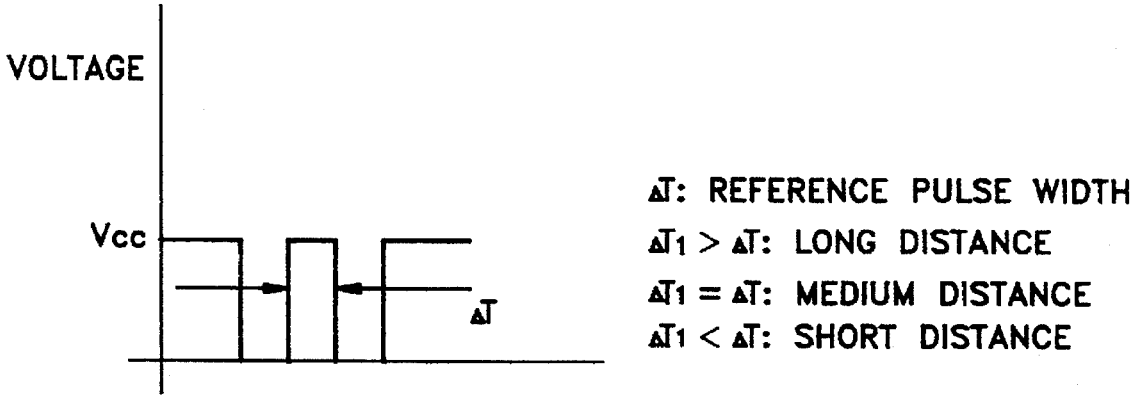
FIG. 10 illustrates the width of an output pulse for the detection areas in the infrared object detector for an air conditioner according to the present invention.

FIG. 10 illustrates a pulse width depending on the distance between the light receiving unit 100 and the detection area. Microcomputer 300, in which three reference values are stored, measures the pulse width of a generated square wave to thereby determine the distance of the detection area according to the reference values.

Figure 11:
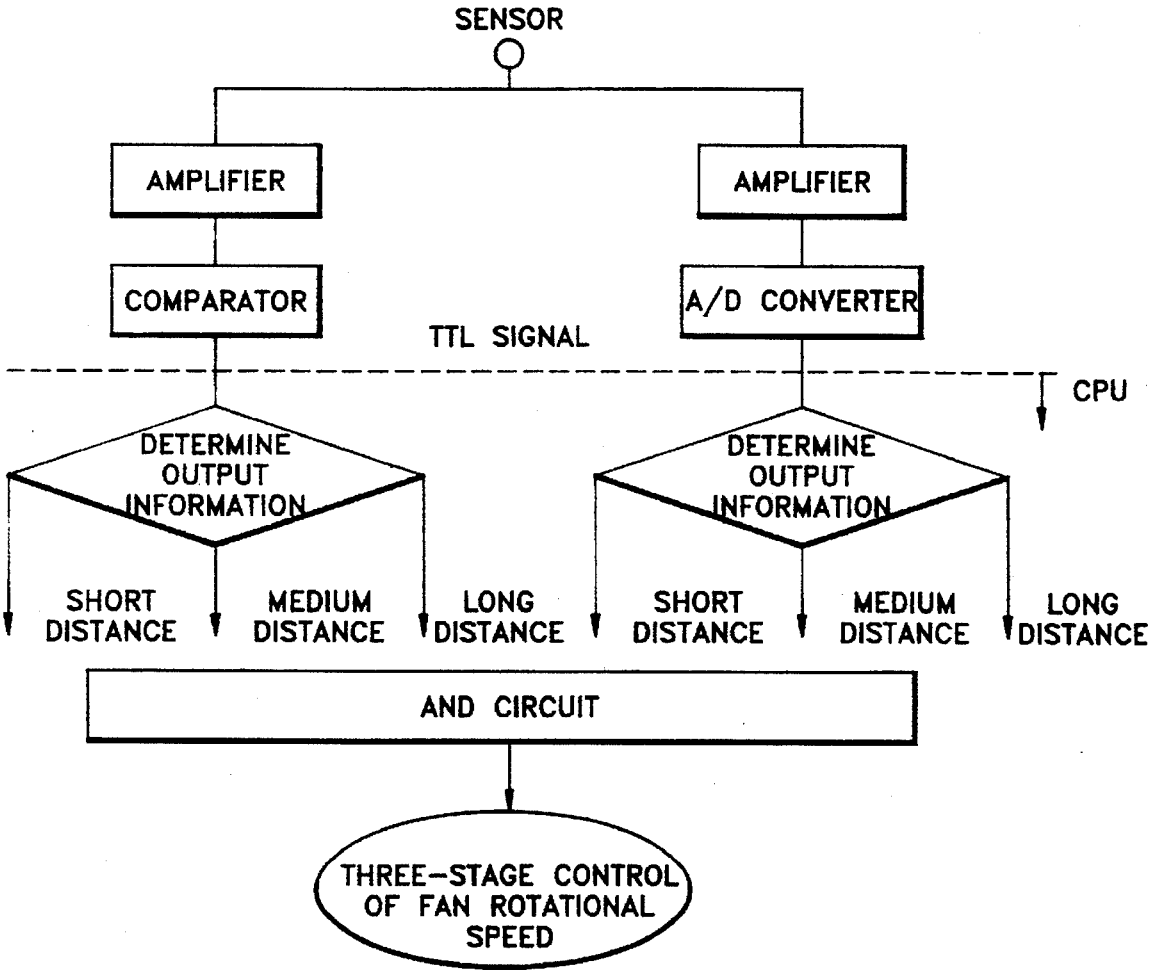
FIG. 11 is a flow-chart for explaining the process of performing a command to operate a fan of the air conditioner according to a signal detected in the infrared object detector for an air conditioner according to the present invention.

Referring to FIG. 11, a received signal indicative of the distance of the detection area is processed in the AND circuit, thereby finally determining the position of the object to be one of the short, medium, and long distances.

The rotational speed of a fan in an air conditioner is classified into three stages according to the determination, and a control signal is output for adequately operating the air conditioner in consideration of the number, locations, and movement degree of persons. Thus, optimum air conditioning is performed according to indoor conditions.

As described above, while the conventional infrared object detector has a limited two-dimensional detection area, the infrared object detector of the present invention has three-dimensional detection areas to detect the distance of an object in terms of short, medium, and long distances. Therefore, in an air conditioner employing the infrared object detector, the distance between a person and an air conditioner is detected, and the airflow of the air conditioner is controlled based on the distance. As a result, power consumption is reduced and optimum air conditioning is possible.

In addition, the infrared object detector of the present invention can be applied to a camcorder or a camera to determine the distance to an object more accurately.

What is claimed is:

1. An infrared object detector comprising:

light receiving means having at least one pair of light receiving lenses on a surface of a printed circuit board, light receiving views of said light receiving lenses intersecting each other to define a plurality of detection areas;

signal processing means having a light receiving element arranged on said printed circuit board, corresponding to each of said light receiving lenses, an amplifier electrically coupled to said light receiving element, a window comparator for comparing an output signal of said amplifier with a reference signal thereof, and a signal converter coupled to said amplifier in parallel with said window comparator for converting said output signal from said amplifier; and determining means for determining the distance of a detection area where an object is located, through a signal output from said signal processing means.

2. An infrared object detector as claimed in claim 1, wherein said signal converter is an A/D converter.

3. An infrared object detector as claimed in claim 1, wherein said light receiving lenses are a pair of Fresnel lenses arranged in parallel, and light blocking means is provided between said Fresnel lenses so that the light receiving views of said Fresnel lenses intersect each other, thereby defining substantially three detection areas.

4. An infrared object detector as claimed in claim 3, wherein each of said pair of Fresnel lenses has a hemispherical light incident surface.

5. An infrared object detector as claimed in claim 3, wherein said light blocking means is a light blocking tape.

6. An infrared object detector as claimed in claim 3, wherein said light blocking means is a mask formed between said Fresnel lenses.

7. An infrared object detector for an air conditioner, comprising:

light receiving means having light blocking means between a pair of Fresnel lenses arranged on a surface of a printed circuit board, so that the light receiving views intersect each other to thereby define three detection areas;

signal processing means having a pair of light receiving elements disposed corresponding to said Fresnel lenses, an amplifier for amplifying an output signal of each of said light receiving elements, a window comparator for comparing an output signal of said amplifier with a reference signal, and an A/D converter coupled to said amplifier in parallel with said window comparator, for converting the output signal of said amplifier; and a microcomputer for receiving a signal output from said signal processing means, determining a distance area where an object is located, and outputting a command signal for controlling the operation of an air conditioner according to the distance.

8. An infrared object detector for an air conditioner as claimed in claim 7, wherein each of said Fresnel lenses has a hemispherical light incident surface.

9. An infrared object detector for an air conditioner as claimed in claim 7, wherein said light blocking means is one of a light blocking tape and a mask.

10. An infrared object detector for an air conditioner as claimed in claim 7, wherein said signal processing means comprises an AND/NOT gate, for classifying signals output from two signal processing circuits thereof into said signal waves for signal detection areas, and determining a corresponding signal detection area.

11. An infrared object detector for an air conditioner as claimed in claim 7, wherein said microcomputer outputs a command signal for controlling the operation of said air conditioner according to the signal wave for the detection area output from said signal processing means.

12. An infrared object detector for an air conditioner as claimed in claim 7, wherein said microcomputer outputs a command signal for controlling the rotational speed of a fan in said air conditioner in three stages according to the signal wave for the detection area output from said signal processing means, thereby controlling the airflow of said air conditioner according to the number and movement degree of persons who are present in said detection area.

* * * * *